US006808407B1

(12) United States Patent
Cannon

(10) Patent No.: US 6,808,407 B1
(45) Date of Patent: Oct. 26, 2004

(54) LOCKING PRECISION MALE BNC CONNECTOR WITH LATCH MECHANISM ALLOWING CABLE ROTATION

(75) Inventor: James E. Cannon, Colorado Springs, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 65 days.

(21) Appl. No.: 10/646,320

(22) Filed: Aug. 22, 2003

(51) Int. Cl.[7] ..... H01R 13/62
(52) U.S. Cl. ..... 439/314; 439/332; 439/578
(58) Field of Search ..... 439/314, 332–335, 439/578–585, 350, 152, 321

(56) References Cited

U.S. PATENT DOCUMENTS

| | | | | | |
|---|---|---|---|---|---|
| 4,340,269 | A | * | 7/1982 | McGeary | 439/583 |
| 4,506,943 | A | * | 3/1985 | Drogo | 439/314 |
| 4,550,967 | A | * | 11/1985 | Riches et al. | 439/332 |
| 4,702,537 | A | * | 10/1987 | Mattingly et al. | 439/152 |
| 5,015,194 | A | * | 5/1991 | Seas | 439/314 |
| 5,695,365 | A | * | 12/1997 | Kennedy et al. | 439/638 |
| 6,602,093 | B1 | * | 8/2003 | Cannon | 439/578 |
| 6,609,925 | B1 | * | 8/2003 | Cannon | 439/332 |
| 6,666,701 | B1 | * | 12/2003 | Burkhardt et al. | 439/314 |

* cited by examiner

*Primary Examiner*—Edwin A. Leon
(74) *Attorney, Agent, or Firm*—Edward L. Miller

(57) ABSTRACT

A precision locking BNC male connector mates without requiring twisting of the cable or multiple bends to accommodate the rotation of the BNC latch. The shell portion of the male connector that carries the adapter connector or cable clamp on one end and that is the male cylindrical shield at the other end, is free to rotate whenever the precision locking BNC male connector is not locked, whether or not it is mated with a female connector. A knurled sleeve is captive at a location along the male shell, but is free to rotate. The knurled sleeve has internal threads that engage external threads on a portion of the BNC latch. A radial friction device is in contact with both an-external surface of the BNC latch and the internal surface of the knurled sleeve. When not engaged with the bayonet pins of a female connector, rotating the knurled sleeve will rotate the BNC latch also, by virtue of the friction device, but both will, as a unit, rotate freely relative to the shell. Once the bayonet pins engage the spiral portion of the slot in the BNC latch, the friction between the sleeve and the latch is sufficient to rotate the latch all the way into the detent. At that point the latch can turn no more, and further CW rotation of the sleeve by about three-quarters of a turn causes thread driven displacement of the male shell toward the female parts by about 0.030 inches. This applies the compression that produces the locked condition. To unlock the connectors the knurled sleeve is turned in the CCW direction. The friction device does not transmit enough torque to overcome the detent, which is also temporarily maintained by an anti-jam spring, so that the shell initially stays still as the knurled sleeve rotates about it, which undoes the thread-induced displacement until no more displacement in the other direction is possible, and further rotation is transmitted to the latch, which causes it to leave its detent and traverse the spiral over the bayonet pins to where they are opposite the entrance to the groove. A simple axial tug then separates the connectors. The friction device may be a neoprene washer held between two adjacent metallic washers.

10 Claims, 5 Drawing Sheets

LOCKING PRECISION MALE BNC CONNECTOR WITH LATCH MECHANISM ALLOWING CABLE ROTATION

BACKGROUND OF THE INVENTION

Through custom and convenience, the preferred connector for general purpose use on many items of test equipment is BNC female (BNC stands for Bayonet Navy Connector). The BNC female connector has a female shell, or cylindrical shield, whose outer surface carries two opposing bayonet pins that engage respective spiral grooves and detents in a bayonet latch that is part of the male BNC connector. The actual RF connection is made between male and female center conductor portions and between male and female cylindrical shield portions. To connect the center conductors, a male pin has a reduced diameter portion that extends beyond a shoulder. The male pin enters a female socket whose outer diameter matches that at the shoulder of the male pin. In this way the mated male and female center conductor portions exhibit no change in outer diameter, provided that they are indeed fully mated. In a similar manner the cylindrical shield around the male pin has an outer diameter that just fits inside the larger cylindrical shield over the female pin. The larger (female) cylindrical shield has an interior step to a reduced diameter that matches the inside diameter of the smaller (male) cylindrical shield over the male pin. When the center conductors are fully mated the smaller cylindrical shield will enter and exactly bottom out against the step in the larger cylindrical shield, and any change in shield inside diameter will vanish, with the result that both the center conductor and the surrounding cylindrical shield each appear to have constant diameters. This mechanical arrangement of overlapping penetration is such that the center conductor and shield are held in rigid coaxial alignment, despite the presence of a mechanical joint. In an ordinary BNC connector, a spring in the back of the BNC latch provides a modest amount of force to cause the full mating of the center pin and the shields. One end of this force is anchored by the detent of the bayonet latch engaging the bayonet pins, and allows the mated parts to be forced together. (This rather abbreviated discussion of the BNC connector technique does not address all issues associated with the BNC design over it long history, such as the use of Teflon, axial slits in the male cylindrical shield, and cable attachment methods. But it is sufficient to raise the issues we are interested in.)

A disadvantage to the original BNC design is that the spring can weaken with age and severe use, and that anything, such as the weight of a long cable or of a probe pod or other housing at the male end, that pulls the male connector away from the panel by overcoming the spring will also cause the mated center conductors and mated shields to each separate to a greater or lesser degree. The resulting diameter variations introduce abrupt changes in characteristic impedance, causing undesirable reflections for signals at high frequencies.

U.S. Pat. No. 6,609,925 issued 26 Aug. 2003 and entitled Precision BNC Connector discloses an arrangement wherein the aforementioned spring is replaced by a deliberate (non-resilient) displacement produced by the rotation of a knurled outer shell engaged by threads to the BNC latch. When the knurled outer shell is turned in the proper direction after an initially mating of the connector, the male pin and its surrounding cylindrical shell are driven forward to fully mate with their female counterparts. As before, the bayonet pins serve as an anchor for the force involved.

Now, it is not that the arrangement described in U.S. Pat. No. 6,609,925 does not work: it does. But there are situations where an aspect of its operation is inconvenient. That is, it is at odds with a human usage model arising out of expectations formed by using other connectors. We shall describe one such situation in order to illuminate a desired property of the improved connector to be described in due course.

Suppose that the instrument or item of test equipment has an input channel using a panel mounted female BNC connector. It is conventional that such connectors are quite rigidly attached to the panel, and do not translate, pivot or rotate once installed. Now let a similar connector be on the panel, some distance away. The second connector is the source of a calibration signal that the user of the instrument wishes, from time to time, to apply to the input channel. The manufacturer of the instrument supplies a high quality (and expensive!) "calibration cable" that is to be used to make the interconnection. The calibration cable might be a length of rigid "hard line" coaxial cable, or semi-rigid cable. Or, it might be flexible, in that it can be bent somewhat, but will resist (and not undergo without damage)torsional rotation, or twisting. (There are other, non-calibration situations where test equipment sometimes has an externally made connection, such as applying by a short coaxial cable either an internally generated or externally supplied standard frequency, or other signal, to an input that uses it. It will be appreciated that these other situations are also represented by the "calibration" example we are about to pursue.)

Suppose, as point of departure, that such a calibration cable was in the shape of a shallow broad U and had conventional BNC male connectors at each end. It is typically fairly short, say, six to twelve inches. It might bend, but not with a small radius, and the two 90° bends of the U shape mean that the length of the cable is already fairly well consumed just to give it that shape. To attach it, one would likely grasp, between thumb and forefinger, each male BNC latch with different hands and align the cable mounted connectors with their panel mounted counterparts. Because the bayonet pins are located some distance back from the end of the panel mounted female connector, some coaxial engagement is possible before further engagement along the axis requires that the bayonet pins actually enter the grooves in the BNC latch on the male connector. Engagement of the bayonet pins with the grooves requires rotational alignment. The BNC latch is typically allowed to rotate freely, so that such alignment is possible. Typically, the operator rotates the BNC latch with wrist motion or by rolling it between the thumb and forefinger. Once the bayonet pins enter the grooves of the latch, a forward motion and further twisting of the latches will connect the calibration cable. The "only" problem here is the low quality of the connection formed by a conventional non-precision BNC connector. Unfortunately, for a calibration signal in the gigahertz region, unsatisfactory connectors can make it appear that the instrument does not meet its specifications. It is for that and other reasons that there are such things as precision BNC connectors.

Now, let's repeat the same operation with the precision BNC connector of U.S. Pat. No. 6,609,925. Suppose, for the moment, that the connectors are cable borne BNC male connectors (that is, they are directly attached to the calibration cable instead of being cross series adapters as shown in the patent). It won't work unless the cable can be twisted as it leaves the connector, or, unless after the 90° bend that is half of the U-shaped bend, the cable can be further bent to make the U into a W, and then (later on) un-bent back into a U again. This is because the back side of that connector (the part that attaches to the cable or that carries the "adapter part") cannot be rotated relative to the BNC latch. (For those that care to look at FIG. 3 of U.S. Pat. No. 6,609,925, it is because dogs 40 can only slide, and not rotate, in slots 41 of male shell 39, and because element 50—representing the cable or adapter—screws tightly into shell 39.) So, in order to engage the bayonet pins of, say, the left-hand pair of connectors, one would have to rotate the left-hand BNC shell about 90° clockwise (as seen from behind) in order to get the spiral portion of the grooves to traverse over the bayonet pins until those bayonet pins enter the detents. That means that a cable assembly that does not permit twisting has to also rotate as the latch is twisted. But then how can the right-hand connectors then stay engaged with each other? (One could pull the right-hand connectors apart (by distorting the U-shape) to allow the whole cable to rotate about the left-hand connectors, but in the end it will not help. Read on.) For the right-hand connectors to remain engaged (even if not yet fully mated) would require that the calibration cable be compliant, either by twisting as it enters a male connector being rotated (which we assume that it will not do), or that it be extra long in the middle of the U, so that it can bend in a couple of places to temporarily become a W. How gross! And what an undignified thing to do to an expensive length of high quality cable. (Not to mention, suppose it is hard line . . . ) Now, with the left-hand connectors mated, the same difficulties are repeated to mate the right-hand connectors, save that it now a little worse, since the left-hand connectors are now rigidly held in place. The upshot is, the calibration cable cannot be easily installed if it is merely bendable and cannot be twisted, and almost cannot be installed at all if it is rigid. Removal of the cable presents the same problems in reverse.

Those familiar with high quality coaxial cable (e.g., Sucoflex microwave cable from Huber+Suhner) will appreciate that, besides being rather expensive, such cable cannot be twisted, is stiff, and does not bend abruptly. These various properties of the cable mean that we have not inflated the calibration cable example to make it appear worse than it really is.

A related example exists when the connectors on the panel are precision BNC connectors, and the calibration cable is equipped with SMA or, better still, APC 3.5 connectors. Now we have a really high quality (and more expensive still) calibration cable to deal with, which perhaps has other uses as well. We continue to assume that it does not twist, and that abrupt bending of it is discouraged. Now let the precision BNC female connectors on the panel each receive a precision cross series adapter to match the style of connector used by the calibration cable. As before, the nature of the cross series adapter is as shown in U.S. Pat. No. 6,609,925, and the "adapter part" does not rotate relative to the BNC latch part. Now, one could proceed simply by mating and tightening the nut-like shells of the connectors on the calibration cable, just as though the instrument originally had those different style connectors instead of BNC. This works, but is, unfortunately, not a pleasant experience, either. The nut-like shells are small, hard to tighten correctly with thumb and forefinger (a special torque wrench is often used by metrology purists), and repeated use of the connectors exposes them to damage and degradation. After a few bouts of sore fingers, and to protect the expensive APC 3.5 connectors, our operator decides to leave the cross series adapters connected to the calibration cable, expecting that it will be much easier to rotate the larger BNC latches, and also expecting that the more mechanically robust and better protected precision BNC connectors will be a better choice for repeated mounting and un-mounting, anyway. The motives are sound, but the bad news is that we are back to the first example of where something has to twist or bend. Either the connectors on the ends of the calibration cable have to be loosened so they can twist in place (ugh! ) and then re-tightened (thus nullifying any advantage and probably inflicting unneeded rotational wear on the mating surfaces of those expensive connectors . . . ), or, the cable has to twist at the connector or bend additionally between the legs of the U (which it either won't or shouldn't).

So, how can we retain the ease of use and electrical performance advantages of the precision BNC connector described in U.S. Pat. No. 6,609,925 while using it (or something like it), either as a male connector mounted directly to the ends of the calibration cable, or, as part of precision cross series adapters that are left permanently attached to the ends of the calibration cable. It would seem that something has got to rotate. What to do?

SUMMARY OF THE INVENTION

A solution to the problem of precision locking BNC male connector installation requiring twisting of the cable or multiple bends to accommodate the rotation of the BNC latch is to arrange that the shell portion of the male connector that carries the adapter connector or cable clamp on one end and that is the male cylindrical shield at the other end, is free to rotate whenever the precision locking BNC male connector is not locked, whether or not it is mated with a female connector. A knurled sleeve, or draw nut, is captive at a location along the male shell, but is free to rotate. The knurled sleeve has internal threads that engage external threads on a portion of the BNC latch. A radial friction device is in contact with both an external surface of the BNC latch and the internal surface of the knurled sleeve, at a location adjacent to the aforementioned external and internal threads. When not engaged with the bayonet pins of a female connector, rotating the knurled sleeve will rotate the BNC latch also, by virtue of the friction device, but both will, as a unit, rotate freely relative to the shell. Once the bayonet pins engage the spiral portion of the slot in the BNC latch, the friction between the sleeve and the latch is sufficient to rotate the latch (CW as viewed from the rear) all the way into the detent. At that point the latch can turn no more, and further CW rotation of the sleeve by about three-quarters of a turn causes thread driven displacement of the male shell toward the female parts by about 0.030 inches. This applies the compression that produces the locked condition. To unlock the connectors the knurled sleeve is turned in the CCW direction. The friction device does not transmit enough torque to overcome the detent, so that the shell initially stays still as the knurled sleeve rotates about it, which undoes the thread induced displacement until no more displacement in the other direction is possible. A spring washer assists in keeping the bayonet pins and the detents engaged until the draw nut has been rotated enough to provide sufficient linear clearance for their non-binding release. When no further displacement is available the knurled shell will not rotate further in the CCW direction without transmitting that rotation to the latch. After the CW three-quarters of a turn is undone by CCW rotation, the male and female shells are no longer urged together, and further CCW rotation of the knurled sleeve is, through the lack of further thread travel, transmitted to the BNC latch, which causes it to leave its detent and traverse the spiral over the bayonet pins to where they are opposite the entrance to the groove, whereupon a simple axial tug separates the connectors. The friction device may be a neoprene washer held between two adjacent metallic washers.

DESCRIPTION OF A PREFERRED EMBODIMENT

Figure 1:
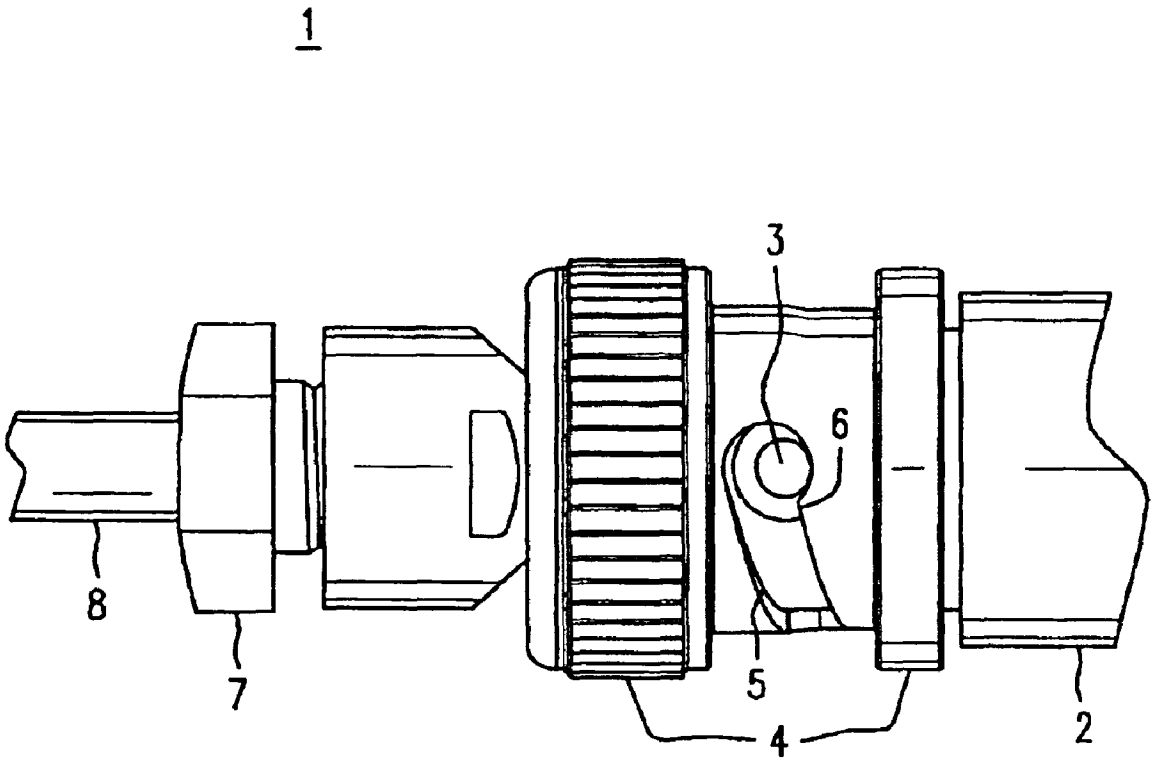
FIG. 1 (PRIOR ART)
FIG. 1 is a side view of a conventional prior art BNC connector.

Refer now to FIG. 1, wherein is shown a side view 1 of a conventional male BNC connector mated to a partially shown female BNC connector 2. The male portion includes a BNC latch 4 having a slot 5 that engages bayonet pins 3 as the latch portion 4 is rotated relative to the female connector 2. A detent region 6 of the slot 5 keeps the connectors engaged. A cable clamp 7 anchors a cable 8 to the rear of the male connector. An item of interest concerning the connector shown in the figure is that, prior to and during mating, the BNC latch 4 can be rotated relative to the cable 8 and its clamp 7. This, as explained in the BACKGROUND, is a desirable property that is missing from the locking precision BNC connector of U.S. Pat. No. 6,609,925.

Figure 2:
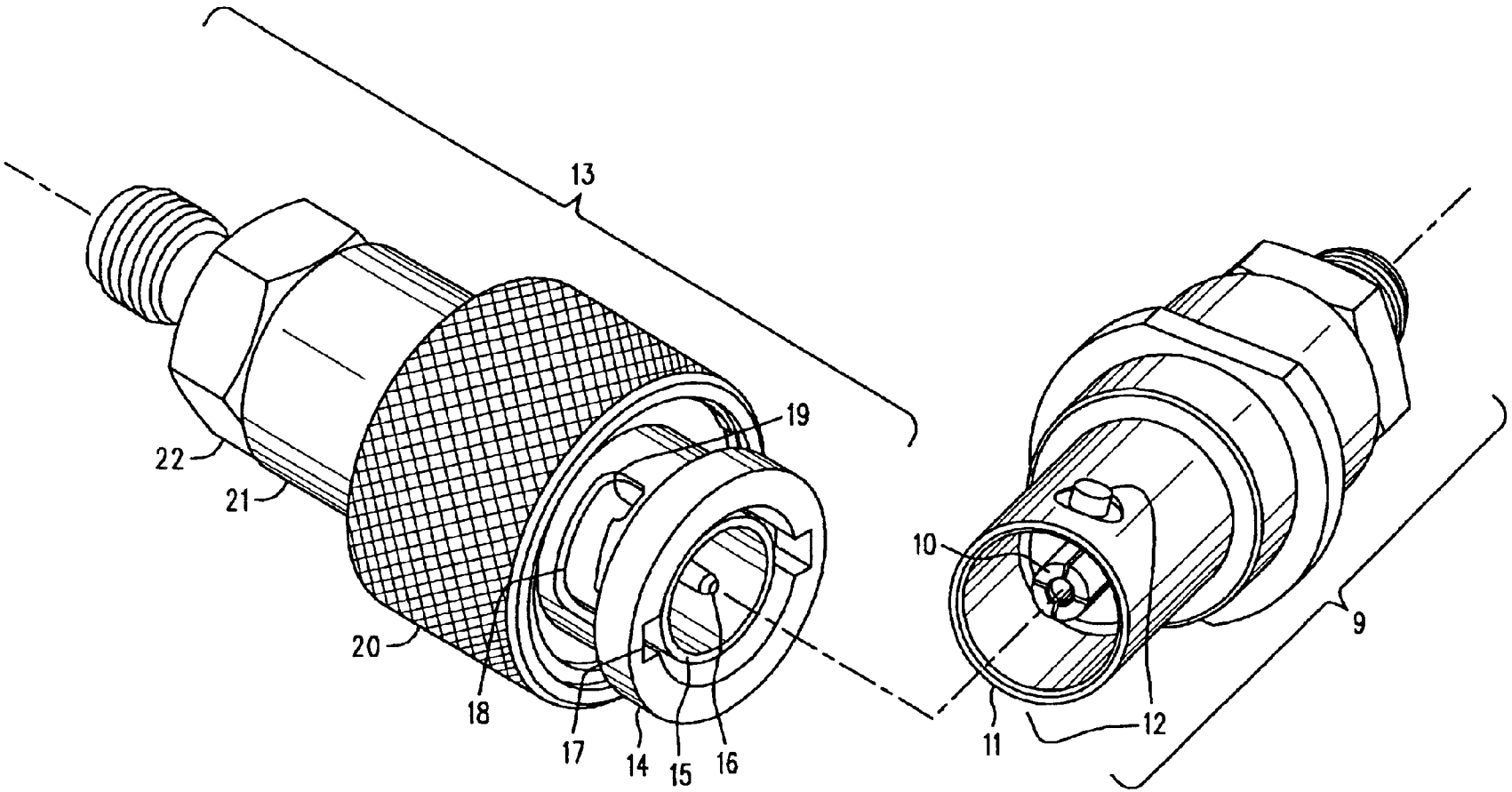
FIG. 2 includes a frontal isometric view of a locking precision male BNC connector whose latch mechanism allows cable rotation.

Refer now to FIG. 2, wherein is shown a female BNC connector 9 that is to be mated with a precision locking male BNC connector 13. The female connector 9 could, in principle, be any female BNC connector, although it will be appreciated that best electrical performance will be achieved when it, too, is a precision connector. In this figure it is shown as being the precision female BNC cross series adapter disclosed in U.S. Pat. No. 6,609,925. In the same vein, the precision locking male BNC connector 13 could be a cable mounted connector, or, as is shown, a cross series adapter.

Note that the female connector 9 has a pair of bayonet pins 12 (one is not visible) located on a female shell 11 that encloses a female center conductor pin 10.

Turning now to the precision locking male BNC connector 13, note that it has a male center conductor pin 16 that mates with its female counterpart 10. It also has a male shell 15 that, when the connector halves are mated, fits inside the female shell 11. Fitting over the male shell 15 is the BNC latch 14, which includes a entrance groove 17 that leads to a spiral groove 18 ending in a detent 19.

Note the draw nut 20, which is preferably knurled for easier gripping. Its purpose is to provide the "locking" action of a locking precision BNC connector, which it does by providing a positive displacement of the male shell 15 and male center pin 16 toward their counterparts (11 and 10, respectively) of the female shell. This displacement occurs until the parts are in firm physical and electrical contact, and is "anchored", as it were, by the bayonet pins 12 being located in their respective detents 19 (of which only one is visible). How this "locking" is accomplished will be described in detail in due course.

Figure 3:
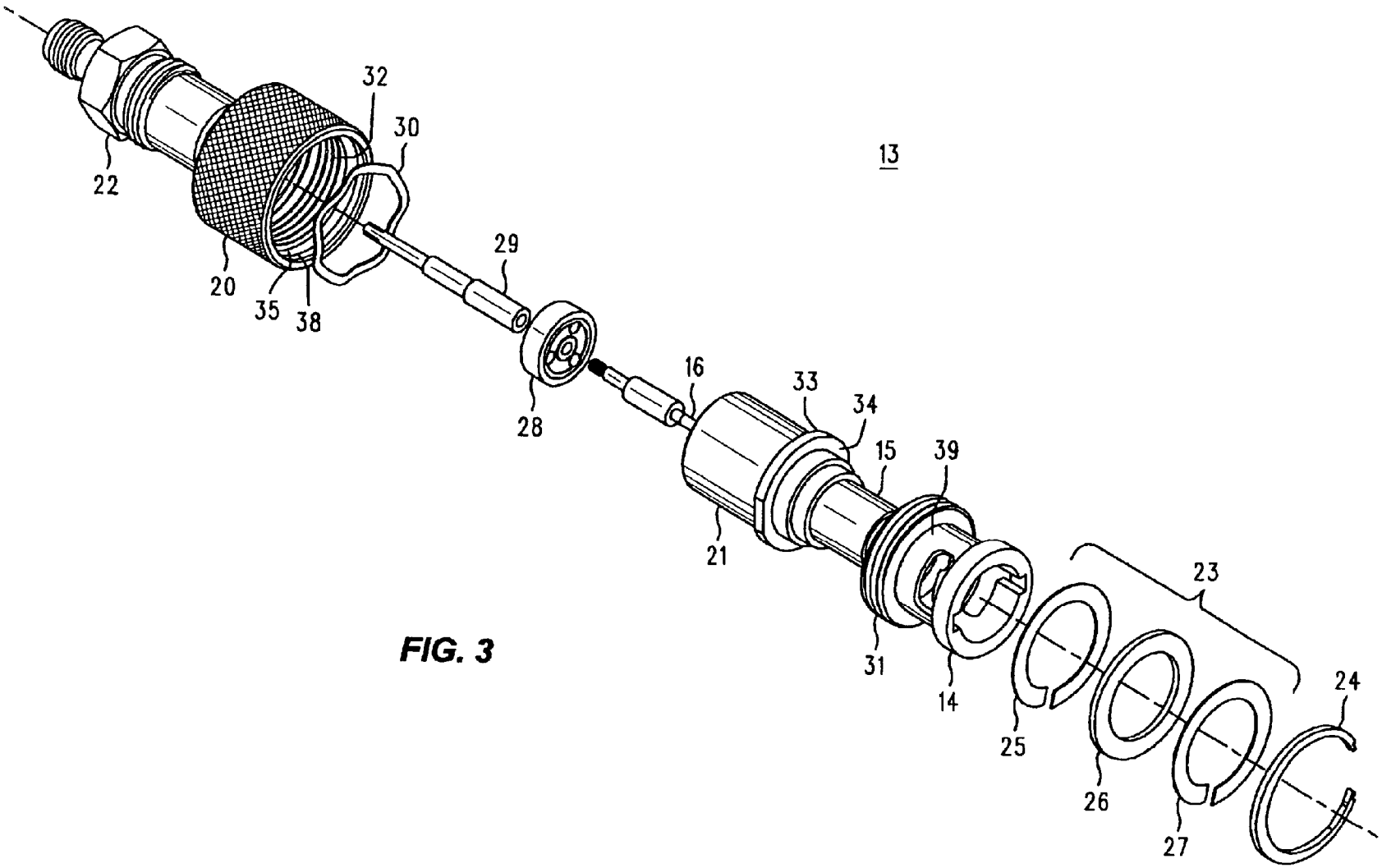
FIG. 3 is an exploded isometric view of the locking precision male BNC connector shown in FIG. 2.
Figure 4:
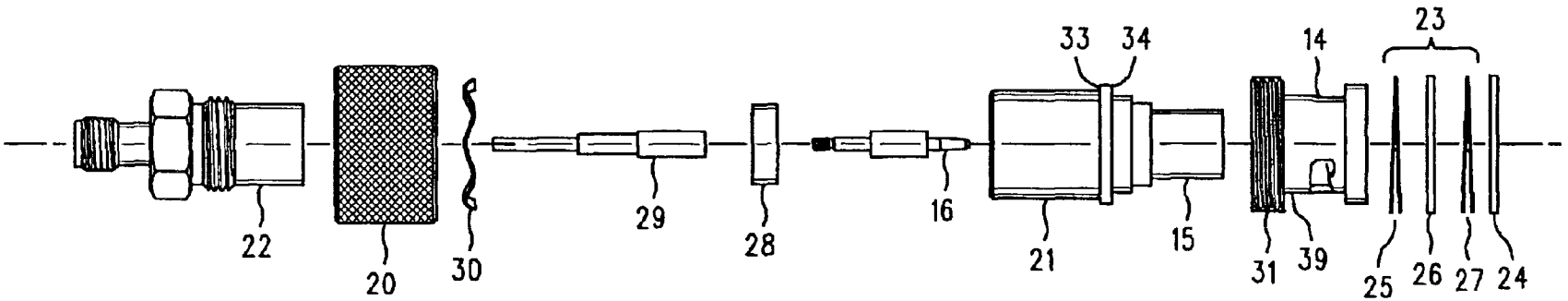
FIG. 4 is an exploded side view of the locking precision male BNC connector of FIG. 2.

Toward the rear of the male BNC connector 13 is a body 21 that, when FIGS. 3 and 4 are studied, will be understood as a rearward extension of the male shell 15. That is, male shell 15 and the body 21 are different portions of the same part, which we might call simply the male body. Adapter 22 is fitted into the rear of the male body 21, forming in this instance an APC 3.5-f to BNC-m cross series adapter. It will, of course, be appreciated the adapter 22 could be replaced with a cable mount mechanism or with connectors of other styles or genders.

An important thing to note about the locking precision male BNC connector 13 shown in FIG. 2 is that, unless its locking mechanism has been engaged (which, it will be remembered, is NOT the same as the bayonet pins 12 being in their detents 19), the BNC latch 14 is free to rotate freely and without limit about the male shell/male body (15/21). Clearly then, any cable connected to the adapter 22, or any cable carrying a connector 13 installed on its end, is also free to rotate relative to the BNC latch 14. Just how that property is obtained while also providing the ability to lock, and the ability to rotate the BNC latch 14 so that its grooves/detents (17, 18, 19) can be made to traverse over the bayonet pins 12, is explained in due course, below. The underlined subject matter of the preceding sentence is of no small import. The exposed portion of the latch 14 itself does not afford much of a gripping region, is smooth, and requires some rotational force to engage, and then later overcome, the detents. The short answer is that a friction drive exists between the interior of the knurled draw nut 20 and an exterior portion of the BNC latch 14 that is enclosed by the draw nut 20.

As a further preliminary, however, here is what one would experience if they were to mate and then lock the two parts 9 and 13 of FIG. 2. Assume that the male connector 13 is unlocked and that the female BNC connector 9 is rigidly attached to some panel (which, of course, is not shown). One would grasp the male connector 13, with the knurled draw nut gripped between a thumb and forefinger. The male connector 13 needs to be aligned with the axis of the female one, by pivoting it 90° CCW as viewed in the drawing, such that the bend in the dotted line between the two connector halves is eliminated. That done, it would then be necessary to rotate the BNC latch 14 so that the entrances 17 to the grooves line up with the bayonet pins 12. That may be accomplished without a second thought, merely by rolling the knurled draw nut 20 between the thumb and forefinger. Note that this rotation may be performed (as set out above in the preceding paragraph), even if the cable (not shown) refuses to rotate. Once the grooves in the BNC latch and the bayonet pins 12 are aligned, the male half 13 is pushed onto the female half 9. At this point the bayonet pins are at the junction of the entrance grooves 17 and the spiral portions 18. Then the knurled draw nut 20 is rotated about a quarter turn CW (as viewed from the back) to cause the spiral portions 18 of the grooves to traverse over the bayonet pins 12 until the bayonet pins are seated in the detents 19. The minor resistance of the relative motion of the bayonet pins and the spiral groove is communicated to the knurled draw nut. Then the knurled draw nut 20 is freely further rotated about three-quarters of a turn CW to perform the locking action. During this additional CW three-quarters of a turn the bayonet pins 12 block further rotation of the bayonet latch 14 (the friction drive is forced to slip), and a thread-driven displacement occurs between the BNC latch 14 and the drawn nut 20. The draw nut 20 is not free to move axially, and the displacement is communicated by shoulders of interfering diameters to the male shell 14 (and to the male center pin 16) as a forward thrust into the female connector half 9. When firm contact is made (after about a half-turn CW and a displacement of about 0.030") the knurled draw nut 20 becomes hard to turn further, and the locking operation is complete.

To unmate and remove the male BNC connector half 13, the knurled draw nut is, once the locking tension is overcome, easily rotated CCW by about a half turn. That fully releases the locking action after which further threaded "un-displacement" is blocked by a retaining mechanism (C-ring 24 in FIGS. 3-5, but which is not readily seen in the view of FIG. 3). During the initial release of the locking mechanism the bayonet pins 12 remain the detents 19; the friction drive does not transmit enough torque to overcome the detents. The gradual release of about 0.020" of resilient compression of waffle washer 30 (or spring washer 30—and it might indeed be a spring) assists in keeping the bayonet pins in the detents until the draw nut has been rotated CCW enough to provide sufficient linear clearance for the detents to climb over the bayonet pins. Without this feature, there is a possibility that the bayonet pins will jam in the detents. However, once the thread-driven "un-displacement" is blocked, further (and temporarily more difficult) CCW rotation of the knurled draw nut 20 causes the BNC latch to rotate CCW also, and the detents 19 leave the bayonet pins without the possibility of jamming. As the bayonet pins and the detents abruptly separate, further relatively easy CCW rotation of the draw nut/BNC latch combination releases the bayonet pins from the groove entirely, and the connector halves may be pulled apart to separate them.

Refer now to FIG. 3, which is an exploded isometric view of the male connector half 13. A convenient place to begin is with the male body 21/15. At one end it is the male shell 15, over which slides for rotation thereon the BNC latch 14. Note that the latch has exterior threads 31 at its interior end. Also sliding over the male shell 15 is a friction drive assembly 23, which is retained in place by a C-ring (or other suitable retaining device) that is held captive in groove 38 on the interior of the draw nut 20.

Sliding over the male body 21 from the other direction are a waffle washer 30 and the knurled draw nut 20. The waffle washer (or spring washer) affords about 0.020" of resilient compression. It could also be some other form of spring. The waffle washer 30 will abut the shoulder 33 on the male body 21, and serves as insurance for easy release and lack of potential bayonet pin binding in the detents during CCW rotation to release the locking action. A reduced diameter bore at the far end of the draw nut slides snugly over the portion 21, and an interior shoulder at the rear of the draw nut abuts the waffle washer 30. (See reference characters 36 and 37 in FIG. 5 for the bore and interior shoulder.) With the draw nut 20 over the male body 21/15, the exterior male threads 31 of the latch 14 can, after the friction drive 23 is installed on the other end of the latch, be threaded into the female threads 32 on the interior of the draw nut.

The friction drive 23 may consist of two nickel plated beryllium copper split washers (25, 27) on either side of a neoprene washer 26. The un-threaded end of the BNC latch 14 has, as is usual, a region of increased diameter. The split washers 25 and 27 are installed by springing them apart and then twisting them on. The neoprene washer 26 can simply be stretched as it is pushed into place. Once the friction drive 23 is in place, and the threads 31 fully threaded into threads 32, the friction drive will be drawn fully into the end of the draw nut 20. At that point the C-ring 24 is snapped into groove 38. This makes the draw nut 20, BNC latch 14 and friction drive 23, all captive on the male body 21.

To complete the assembly of male connector half 13, note the center conductor support bead 28. As can be seen from an inspection of FIG. 5, it is held in place by a reduced diameter shoulder interior to the male body 21, and the threaded insertion of the adapter 22. In turn, the center conductor support bead 28 carries the two center conductors 16 and 29. The details of this part of the male connector half 13 are essentially as set out in the corresponding portion of U.S. Pat. No. 6,609,925. Note that the details shown here are for a cross series adapter, and would be slightly different (although in a conventional manner) if a cable were being affixed in place of the adapter 22.

Here now is some additional detail describing one successful embodiment for the friction drive 23. The exterior portion 39 of the BNC latch 14 that carries the friction drive 23 has an outer diameter of 0.450". The neoprene washer 26 is 0.035" in thickness, and has an outer diameter of 0.632" and an inner diameter of 0.447". The two spit washers 25 and 27 are identical to one another, 0.008" thick, have an inner diameter of 0.454" and an outer diameter of 0.628". The interior diameter of the draw nut at the location therein receiving the friction drive (see 35 in FIG. 5) is 0.632". Note that these dimensions ensure a slight amount of interference between the neoprene washer 26 and the surfaces (35, 39) that it is to provide a friction drive between. It will be appreciated that there are other ways that a friction drive 23 could be implemented.

FIG. 4 shows the same parts as FIG. 3, only as a side view.

Figure 5:
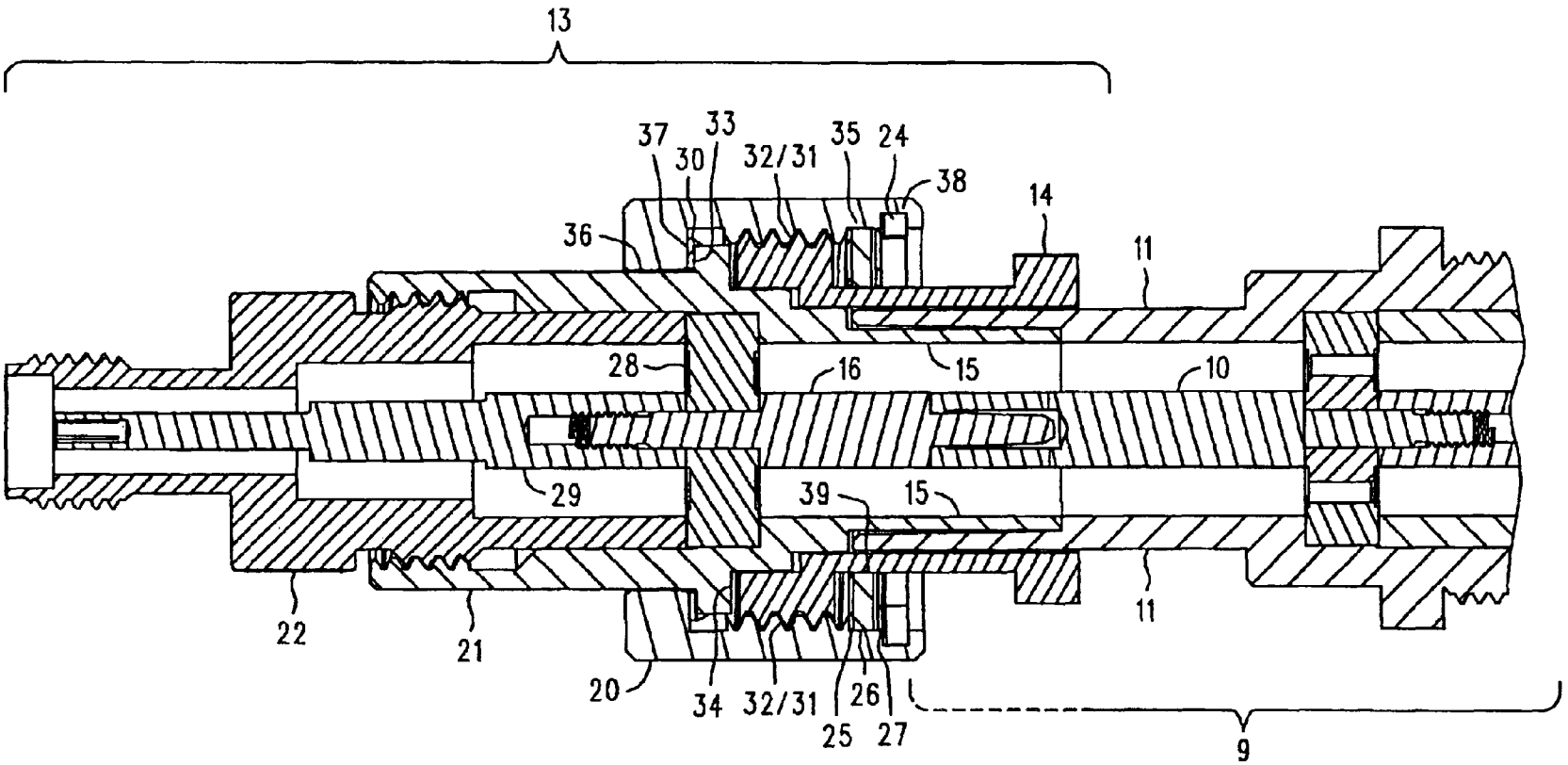
FIG. 5 is a sectional side view of the locking precision male BNC connector of FIG. 2 mated with a female BNC connector.

Finally, refer now to FIG. 5, which is a sectional side view of the mated connector halves 9 and 13 of FIG. 2. Not visible in the figure, however, are the bayonet pins. The exterior threads 31 on the BNC latch 14 and the interior threads 32 in the draw nut 20 are right hand threads. This arises from the CW rotation (as viewed from behind) needed to engage the standard BNC latch mechanism. Note that when the draw nut is turned fully CCW over the latch 14, shoulder 37 of the draw nut 20 is allowed to pull away from shoulder 33 of the male body 21 as the latch extends outward from the draw nut. This releases the waffle washer 30 from all compression, and allows the combination of the draw nut and latch to rotate freely about the male body 21, or in the event a cable has to move (during mating of another connector at a distal end of that cable . . . ), the cable body 21 can rotate inside a stationary draw nut/latch combination. The amount of such CCW draw nut rotation is limited by how far the latch can extend before the (as seen in the figure) right-hand end of the threaded region 31 jams against the friction drive, as buttressed by the retainer 24. The amount of associated linear travel is about 0.040". During the mating of connectors, CW draw nut rotation uses about 0.030" of the available travel to accomplish the draw-in locking, leaving about 0.010" as margin. Now suppose that for an un-mated male connector all available CW rotation of the draw nut were applied (this requires holding the end of the latch). In this case the left-hand end of the threaded region 31 would bottom out against shoulder 34, and prevent further rotation. This is an un-natural condition that would not normally be produced by using the connector, and is a minor impediment to mating the connector. The condition is easily overcome, however, by merely starting the BNC latch grooves onto the bayonet pins (to hold the latch), and then applying a CCW rotation to the draw nut to unlock the male half, and then proceeding as usual.

I claim:

1. A male BNC connector half comprising:

a male BNC connector shell having a shouldered bore therethrough and forming at one end a mating cylinder for entering a female BNC connector shell having bayonet pins;

a bayonet latch having spiral grooves ending in detents for engaging bayonet pins when the mating cylinder enters the female BNC connector shell, and having a region of external threads;

the bayonet latch slidably and rotatably affixed to the male BNC connector shell and over the mating cylinder;

a center conductor support bead having a central hole therein and that fits snugly in the shouldered bore and rests against an internal shoulder therein when inserted into the shouldered bore from an end opposite the location of the mating cylinder;

a threaded retaining member that screws into the shouldered bore at the end opposite the location of the mating cylinder and that contacts the center conductor support bead and holds it against the internal shoulder;

a male center conductor pin held coaxially along the axis of the shouldered bore by threaded compression through the central hole in the center conductor support bead and which forms an air dielectric transmission line with the interior of the mating cylinder;

a connecting center conductor passing coaxially through a bore in the threaded retaining member, which threadably mates with the male center conductor pin through the central hole in the center conductor support bead to provide the above recited threaded compression, and that is part of a transmission line for carrying signals to and from the male BNC connector half;

the male BNC connector shell also having an external shoulder proximate the location where the bayonet latch is affixed thereto; and a draw nut having a bore therethrough with internal threads thereon, having a reduced diameter at one end that slides snugly over the outside of the BNC male conductor shell proximate the external shoulder thereon and in a direction that is from the threaded retaining member toward the mating cylinder, in an orientation where the internal threads pass over the external shoulder and rotatably engage the external threads of the bayonet latch;

a retainer affixed into bore of the draw nut at the end thereof opposite that having the reduced diameter;

a friction medium disposed in the bore of the draw nut and within a region bounded by the region of external threads of the bayonet latch and the retainer, the friction medium in contact with a cylindrical outer surface of the bayonet latch and with a cylindrical inner surface of the draw nut;

the friction medium communicating to the bayonet latch a selected amount of a rotational force in either direction applied to the draw nut.

2. A male BNC connector half as in claim 1, wherein the retainer is a compressed circular ring expanding into a groove in the bore of the draw nut.

3. A male BNC connector half as in claim 1, wherein the threaded retaining member comprises a female APC 3.5 connector shell and the connecting center conductor comprises an APC 3.5 female center conductor pin.

4. A male BNC connector half as in claim 1, wherein the threaded retaining member comprises a clamp type cable attachment.

5. A male BNC connector half as in claim 1, wherein the threaded retaining member comprises a connector shell of another series of RF connectors, and the connecting center conductor comprises a center conductor pin belonging to that other series.

6. A male BNC connector half as in claim 1, wherein the friction medium comprises rubber and has a cylindrical shape with a bore therein.

7. A male BNC connector half as in claim 6, wherein the rubber is neoprene.

8. A male BNC connector half as in claim 6, wherein the friction medium further comprises a metallic washer at each end of the bore therein.

9. A male BNC connector half as in claim 1, further comprising a resilient compressible member disposed between the external shoulder of the connector shell and the reduced diameter of the draw nut.

10. A male BNC connector half as in claim 9, wherein the resilient compressible member is a spring washer.

* * * * *